US006795804B1

(12) United States Patent
Goel et al.

(10) Patent No.: US 6,795,804 B1
(45) Date of Patent: Sep. 21, 2004

(54) SYSTEM AND METHOD FOR ENHANCING SPEECH AND PATTERN RECOGNITION USING MULTIPLE TRANSFORMS

(75) Inventors: Nagendra Kumar Goel, McLean, VA (US); Ramesh Ambat Gopinath, Millwood, NY (US)

(73) Assignee: International Business Machines Corporation, Armonk, NY (US)

( * ) Notice: Subject to any disclaimer, the term of this patent is extended or adjusted under 35 U.S.C. 154(b) by 533 days.

(21) Appl. No.: 09/703,821

(22) Filed: Nov. 1, 2000

(51) Int. Cl.[7] ..... G10L 19/02
(52) U.S. Cl. ..... 704/203; 704/222
(58) Field of Search ..... 704/219, 221, 704/222, 223, 230, 203, 210

(56) References Cited

U.S. PATENT DOCUMENTS 4,908,865 A * 3/1990 Doddington et al. ..... 704/241
5,054,083 A * 10/1991 Naik et al. ..... 704/272
5,278,942 A * 1/1994 Bahl et al. ..... 704/200
5,754,681 A * 5/1998 Watanabe et al. ..... 382/159
6,131,089 A * 10/2000 Campbell et al. ..... 706/20
2001/0019628 A1 * 9/2001 Fujimoto et al. ..... 382/225

* cited by examiner

*Primary Examiner*—Richemond Dorvil
*Assistant Examiner*—Abul K. Azad
(74) *Attorney, Agent, or Firm*—F. Chau & Associates, LLC

(57) ABSTRACT

A system and method for applying a linear transformation to classify and input event. In one aspect, a method for classification comprises the steps of capturing an input event; extracting an n-dimensional feature vector from the input event; applying a linear transformation to the feature vector to generate a pool of projections; utilizing different subsets from the pool of projections to classify the feature vector; and outputting a class identity of the classified feature vector. In another aspect, the step of utilizing different subsets from the pool of projections to classify the feature vector comprises the steps of, for each predefined class, selecting a subset from the pool of projections associated with the class; computing a score for the class based on the associated subset; and assigning, to the feature vector, the class having the highest computed score.

16 Claims, 6 Drawing Sheets

SYSTEM AND METHOD FOR ENHANCING SPEECH AND PATTERN RECOGNITION USING MULTIPLE TRANSFORMS

BACKGROUND

1. Technical Field

This application relates generally to speech and pattern recognition and, more specifically, to multi-category (or class) classification of an observed multi-dimensional predictor feature, for use in pattern recognition systems.

2. Description of Related Art

In one conventional method for pattern classification and classifier design, each class is modeled as a gaussian, or a mixture of gaussian, and the associated parameters are estimated from training data. As is understood, each class may represent different data depending on the application. For instance, with speech recognition, the classes may represent different phonemes or triphones. Further, with handwriting recognition, each class may represent a different handwriting stroke. Due to computational issues, the gaussian models are assumed to have a diagonal co-variance matrix. When classification is desired, a new observation is applied to the models within each category, and the category, whose model generates the largest likelihood is selected.

In another conventional design, the performance of a classifier that is designed using gaussian models is enhanced by applying a linear transformation of the input data, and possibly, by simultaneously reducing the feature dimension. More specifically, conventional methods such as Principal Component Analysis, and Linear Discriminant Analysis may be employed to obtain the linear transformation of the input data. Recent improvements to the linear transform techniques include Heteroscedastic Discriminant Analysis and Maximum Likelihood Linear Transforms (see, e.g., Kumar, et al., "Heteroscedastic Discriminant Analysis and Reduced Rank HMMs For Improved Speech Recognition," *Speech Communication*, 26:283–297, 1998).

More specifically, FIG. 1*a* depicts one method for applying a linear transform to an observed event x. With this method, a precomputed n×n linear transformation, $\theta^T$, is multiplied by an observed event x (an n×1 feature vector), to yield and n×1 dimensional vector, y. The vector y is modeled as a gaussian vector with a mean $u_j$ and variances $\Sigma_j$ for each different class. The same y is used and a different mean and variance is assigned for each different class to model that same y. The variances for each class are assumed to be diagonal covariance matrices.

In another conventional method depicted in FIG. 1*b*, instead of a single linear transformation $\theta^T$ (as in FIG. 1*a*), a plurality of linear transformation matrices $\theta_1^T$, $\theta_2^T$ are implemented, as long as the value of the determinant is constrained to be "1" (unity). Then one transformation is applied for one set of classes, and other to another set of classes. With this method, each class may have its own linear transformation θ, or two or more classes may share the same linear transformation θ.

SUMMARY OF THE INVENTION

The present invention is directed to a system and method for applying a linear transformation to classify and input event. In one aspect, a method for classification comprises the steps of:

capturing an input event;

extracting an n-dimensional feature vector from the input event;

applying a linear transformation to the feature vector to generate a pool of projections;

utilizing different subsets from the pool of projections to classify the feature vector; and outputting a class identity associated with the feature vector.

In another aspect, the step of utilizing different subsets from the pool of projections to classify the feature vector comprises the steps of:

for each predefined class, selecting a subset from the pool of projections associated with the class;

computing a score for the class based on the associated subset; and assigning, to the feature vector, the class having the highest computed score.

In yet another aspect, each of the associated subsets comprise a unique predefined set of n indices computed during training, which are used to select the associated components from the computed pool of projections.

In another aspect, a preferred classification method is implemented in Gaussian and/or maximum-likelihood framework.

The novel concept of applying projections is different from the conventional method of applying different transformations because the sharing is at the level of the projections. Therefore, in principle, each class (or large number of classes) may use different "linear transforms", although the difference between such transformations may arise from selecting a different combination of linear projections from a relatively small pool of projections. This concept of applying projections can advantageously be applied in the presence of any underlying classifier.

These and other aspects, features and advantage of the present invention will be described and become apparent from the following detailed description of preferred embodiments, which is to be read in connection with the accompanying drawings.

DESCRIPTION OF PREFERRED EMBODIMENTS

Figure 1A:
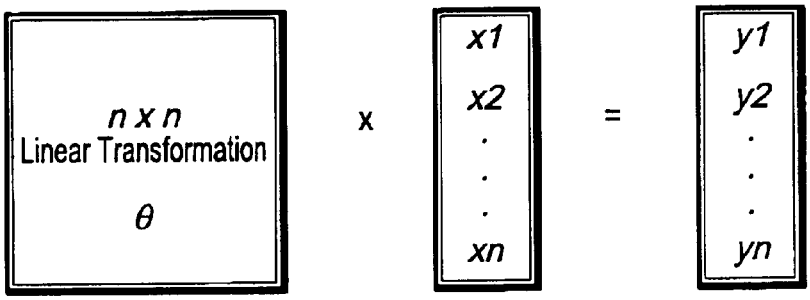
FIG. 1a (Prior Art)
FIGS. 1*a* and *b* illustrate conventional methods for applying linear transforms in a classification process.
Figure 1B:
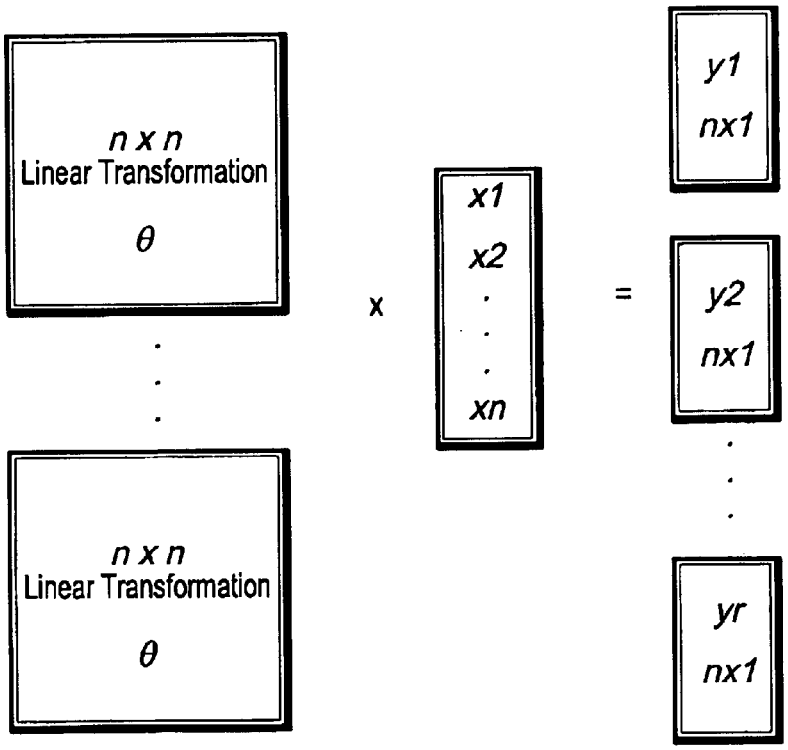
FIG. 1b (Prior Art)
Figure 2:
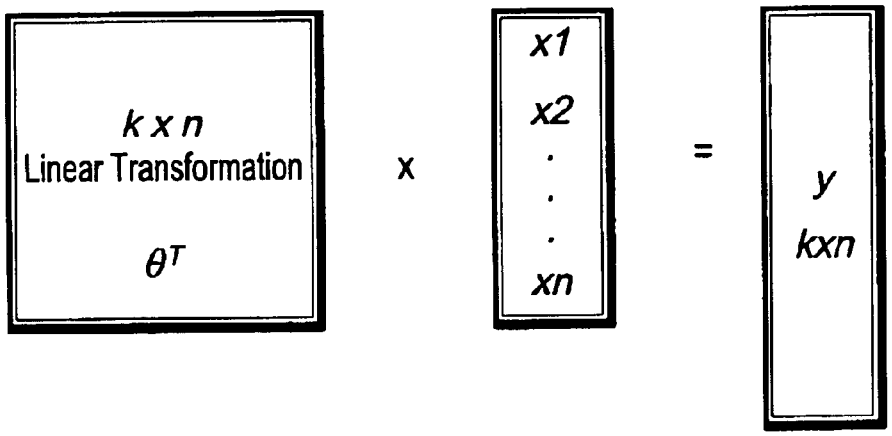
FIG. 2 illustrates a method for applying linear transform in a classification process according to one aspect of the present invention.

In general, the present invention is an extension of conventional techniques that implement a linear transformation, to provide a system and method for enhancing, e.g., speech and pattern recognition. It has been determined that it is not necessary to apply the same linear transformation to the predictor feature x (such as described above with reference to FIG. 1*a*). Instead, as depicted in FIG. 2, it is possible to compute a linear transform of K×n dimensions, where K>n, which is multiplied by a feature x (of n×1 dimensions) to create a pool of projections (e.g., a y vector of dimension K×1) wherein the pool is preferably larger in size than the feature dimension.

Then for each class, a n subset of K transformed features in the pool y is used to compute the likelihood of the class. For instance, the first n values in y would be chosen for class 1, and a different subset of n values in y would be used for class 2 and so on. The n values for each of the class are predetermined at training. The nature of the training data and how accurately you want the training data to be modeled determines the size of y. In addition, the size of y may also depend on the amount of computational resources available at the time of training and recognition. This concept is different from the conventional method of using different linear transformations as described above, because the sharing is at the level of projections (in the pool y). Therefore, in principle, each class, or a large number of classes may use different "linear transformations", although the difference between those transformations may arise only from choosing a different combination of linear projections from the relatively small pool of projections y.

The unique concept of applying projections can be applied in the presence of any underlying classifier. However, since it is popular to use Gaussian or Mixture of Gaussian, a preferred embodiment described below relates to methods to determine (1) the optimal directions, and (2) projection subsets for each class, under a Gaussian model assumption. In addition, although several paradigms of parameter estimation exist, such as maximum-likelihood, minimum-classification-error, maximum-entropy, etc., a preferred embodiment described below presents equations only for maximum-likelihood framework, since that is most popular.

The systems and methods described herein may be implemented in various forms of hardware, software, firmware, special purpose processors, or a combination thereof. The present invention is preferably implemented as an application comprising program instructions that are tangibly embodied on a program storage device (e.g., magnetic floppy disk, RAM, ROM, CD ROM and/or Flash memory) and executable by any device or machine comprising suitable architecture. Because some of the system components and process steps depicted in the accompanying Figures are preferably implemented in software, the actual connections in the Figures may differ depending upon the manner in which the present invention is programmed. Given the teachings herein, one of ordinary skill in the related art will be able to contemplate these and similar implementations or configurations of the present invention.

Figure 3:
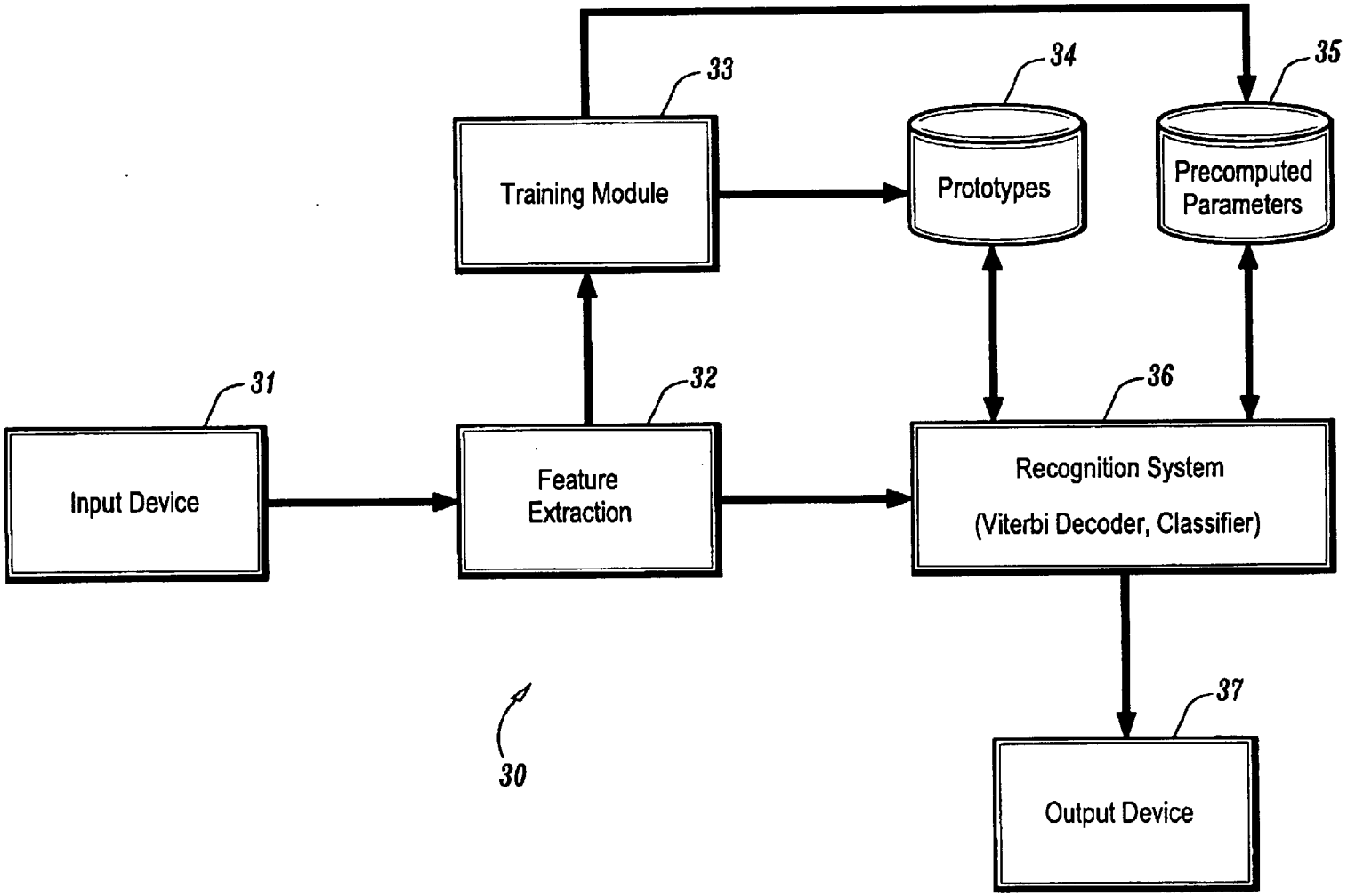
FIG. 3 comprise a block diagram of a classification system according to one embodiment of the present invention.

Referring now to FIG. 3, a block diagram illustrates a classification system 30 according to an exemplary embodiment of the present invention. The system 30 comprises an input device 31 (e.g., a microphone, an electronic notepad) for collecting input signals (e.g., speech or handwriting data) and converting the input data into electronic/digitized form. A feature extraction module 32 extracts feature vectors from the electronic data using any known technique that is suitable for the desired application. A training module 33 is provided to store and process training data that is input to the system 30. The training module 33 utilizes techniques known in the art for generating suitable prototypes (either independent, dependent or both) that are used during a recognition process. The prototypes are stored in a prototype database 34. The training module 33 further generates precomputed parameters, which are stored in database 35, using methods according the present invention. Preferred embodiments of the precomputed parameters and corresponding methods are described in detail below. The system 30 further comprises a recognition system 36 (also known as a Viterbi Decoder, Classifier, etc.) which utilizes the prototypes 34 and precomputed parameters 35 during a real-time recognition process, for example, to identify/classify input data, which is either stored in system memory or output to a user via the output device 37 (e.g., a computer monitor, text-to-speech, etc.) A recognition/classification technique according to one aspect of the present invention (which may be implemented in the system 30) will now be described in detail with reference to FIG. 4.

Figure 4:
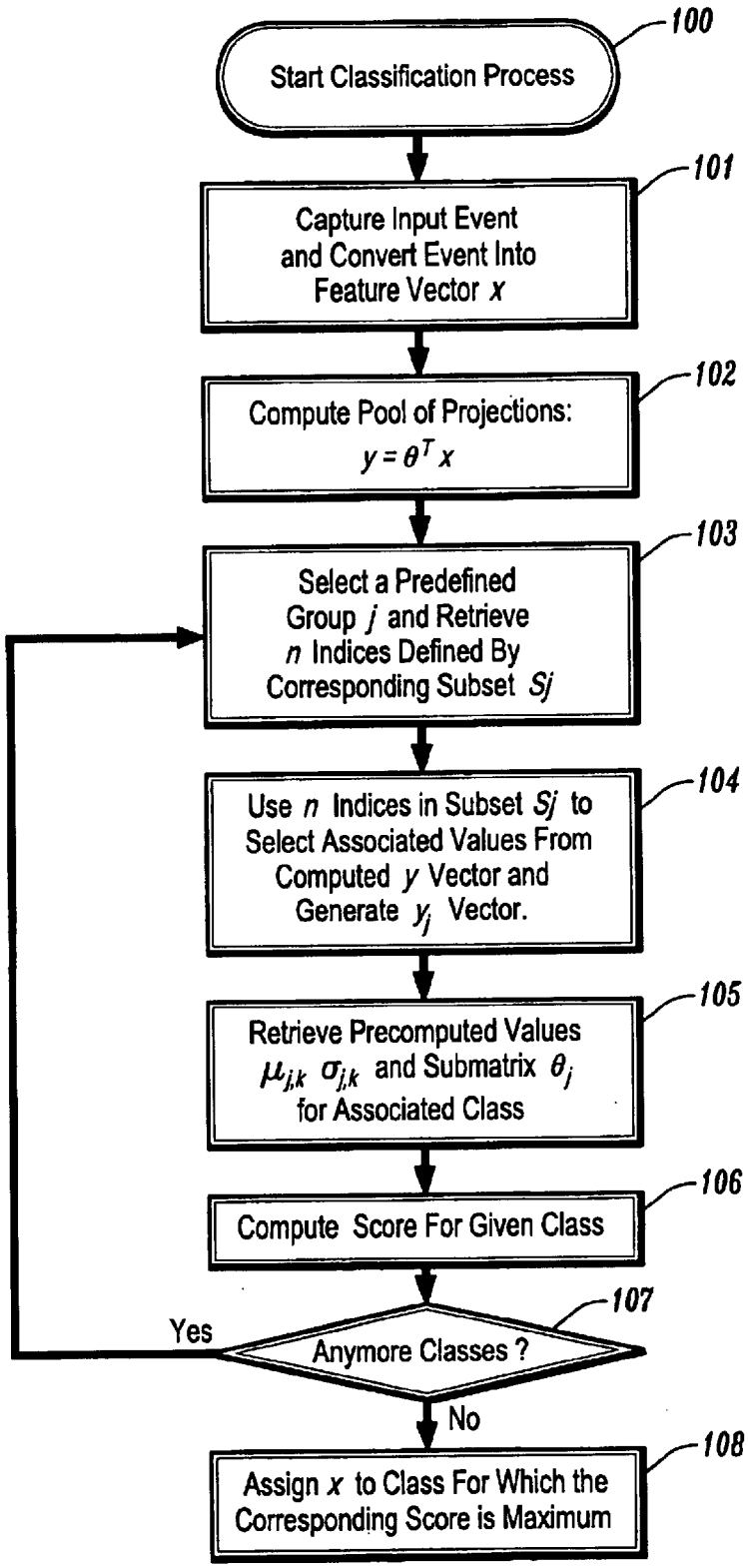
FIG. 4 comprises a flow diagram of a classification method according to one aspect of the present invention.

FIG. 4 is a flow diagram that illustrates a method for classifying an observed event according to one aspect of the invention. The following method is preferably implemented in the system of FIG. 3. During run-time of the system (step 100), an event is received (e.g., uttered sound, handwritten character, etc.) and converted to an n-dimensional real-valued predictor feature x (step 101). Then, x is multiplied by a transposed n×k linear transformation matrix $$\theta^{T:y=\theta T}\chi \qquad \text{Equ. 1}$$

to compute a pool of projections y, where θ is a linear transform that is precomputed during training (as explained below), y comprises a k dimensional vector, and k is an integer that is larger than or equal to n (step 102).

Next, a predefined class j is selected and the n indices defined by the corresponding subset Sj are retrieved (step 103). More specifically, during training, a plurality of classes j (j=1 . . . J) are defined. In addition, for each class j, there is a pre-defined subset $S_j$ containing n different indices from the range 1 . . . k. In other words, each of the predefined subsets Sj comprise a unique set of n indices (from a y vector computed during training using the training data) corresponding to a particular class j. For instance, the first n values in y (computed during training) would be chosen for class 1, and a different subset of n values in y would be used for class 2 and so on.

Then, the n indices of the current Sj, are used to select the associated values from the current y vector (computed in step 102) to generate a $y_j$ vector (step 104). The term $y_j$ is defined herein as the n dimensional vector that is generated by selecting the subset $S_j$ from y (i.e., by selecting n values from y). In other words, this step allows for the selection of the indices in the current y vector that are associated with the given class j. Moreover, the value $y_{j,k}$ is the k'th component of $y_j$ (k=1 . . . n).

Another component that is defined during training is $\theta_j$, which is dependent on θ (which is computed during training). The term $\theta_j$ is defined as a n×n submatrix of θ, which is concatenation of the columns of θ, corresponding to indices in $S_j$. In other words, $\theta_j$ corresponds to those columns of θ that correspond to the subsets Sj.

Another component that is computed during training is $\sigma_{j,k}$ which is defined as a positive real number denoting the variance of k'th component of the j'th class, as well as $\mu_{j,k}$, which is defined as a mean of the k'th component of the j'th class.

The next step is to retrieve the precomputed values for $\sigma_{j,k}$, $\mu_{j,k}$, and $\theta_j$ for the current class j (step 105), and compute the score for the current class j, preferably using the following formula step 106)(step 105):

$$P_j = 2\log|\theta_j| - \sum_{k=1}^{n} \log\sigma_{j,k} - \sum_{k=1}^{n} \frac{(y_{j,k} - \mu_{j,k})^2}{\sigma_{j,k}} \quad \text{Equn. 2}$$

This process (steps 103–106) is repeated for each of the classes j=(1 . . . J), until there are no classes remaining (negative determination in step 108). Then, the observation x assigned to that class for which the corresponding value of $P_j$ is maximum (step 403) and the feature x is output with the associated category feature value g.

Figure 5:
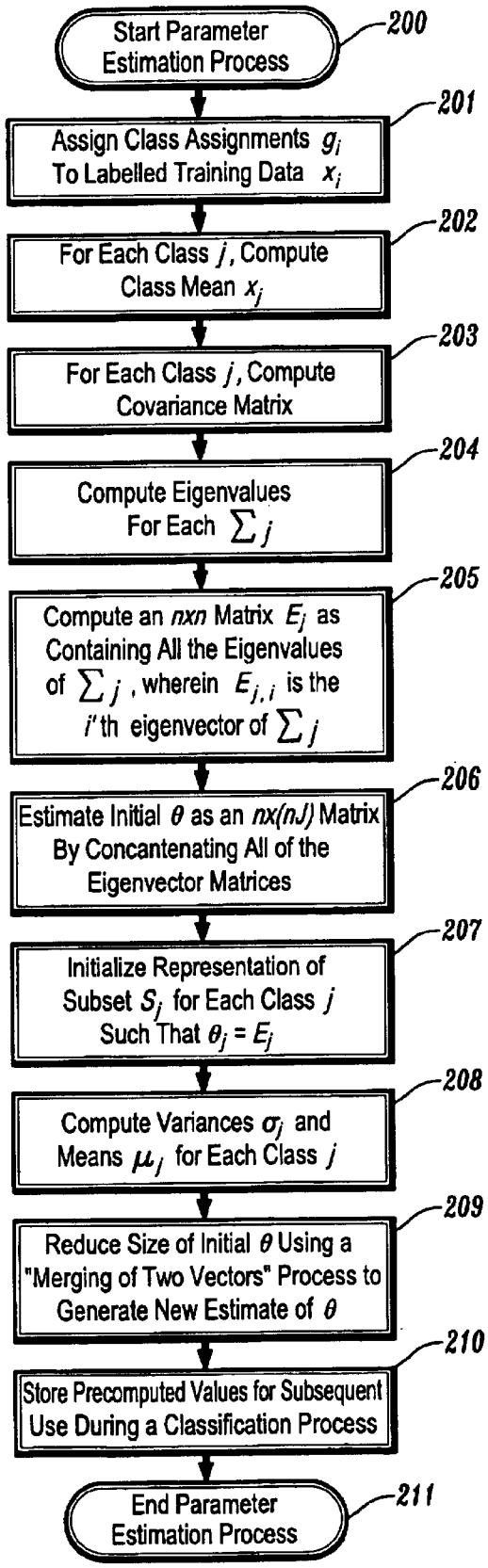
FIG. 5 comprises a flow diagram of a method for estimating parameters that are used for a classification process according to one aspect of the present invention.

Referring now to FIG. 5, a flow diagram illustrates a method for estimating the training parameters according to one aspect of the present invention. In particular, the method of FIG. 5 is a clustering approach that is preferably used to compute the parameters θ, $S_j$, $\sigma_{j,k}$, and $\mu_{j,k}$ in a Gaussian system. The parameter estimation process is commenced during training of the system (step 200). Assume that initially, some labeled training data $x_i$ is available, for which, the class assignments $g_i$ have been assigned (step 201).

Using the training data assigned to a particular class j, the class mean for the class j is computed as follows:

$$\overline{x}_j = \frac{\sum_{gi=j} x_j}{\sum_{gi=j} 1}, \quad \text{Equn. 3}$$

where $\overline{x}_j$ comprises an n×1 vector (step 202). The class mean for each class is computed similarly. In addition, using the training data assigned to a particular class j, a covariance matrix for the class j is computed as follows:

$$\Sigma_j = \frac{\sum_{gi=j} (x_j - \overline{x}_j)(x_j - \overline{x}_j)^T}{\sum_{gi=j} 1} \quad \text{Equn. 4}$$

where $\Sigma_j$ is an n×n matrix. The covariance is similarly computed for each class.

Next, using an eigenvalue analysis, all of the eigenvalues of each of the $\Sigma_j$ are computed (step 204). An n×n matrix $\Sigma_j$ is generated comprising all the eigenvectors of a given $\Sigma_j$, wherein the term $\Sigma_{j,i}$ represents the i'th eigenvector of a given $\Sigma_j$.

An initial estimate of θ is then computed as an nx(nJ) matrix by concatenating all of the eigenvector matrices as follows (step 206):

$$\theta = [E_1 \ldots E_J] \quad \text{Equn.5.}$$

Further, an initial estimate of $S_j$ for each class j is computed as follows (step 207):

$$S_j = \{n(j-1)+1, \ldots nj\} \quad \text{Equn.6,}$$

such that $\theta_j = E_j$. In other words, what this steps does is initialize the representation of each subset Sj as a set of indices. For instance, if subset $S_1$ corresponding to class 1 comprises the first n components of θ, then $S_1$ is listed as {1 . . . n}. Similarly, $S_2$ would be represented as {n+1 . . . 2n}, and $S_3$ would be represented as {2n+1 . . . 3n}, etc.

After θ and $S_j$ are known, the means $\mu_j$ and variances $\sigma_j$ for each class j are computed as follows (step 208):

$$\mu_j = \frac{\sum_{gi=j} \theta_j^T x_i}{\sum_{gi=j} 1}, \text{ and} \quad \text{Equn. 7}$$

$$\sigma_j = \frac{\sum_{gi=j} (\theta_j^T x_i - \mu_j)^2}{\sum_{gi=j} 1}. \quad \text{Equn. 8}$$

After all the above parameters are computed, the next step in the exemplary parameter estimation process is to reduce the size of the initially computed θ to compute a new θ that is ultimately used in a classification process (such as described in FIG. 2) (step 209). Preferably, this process is performed using what is referred to herein as a "merging of two vectors" process, which will now be described in detail with reference to FIG. 6. This process is preferably commenced to reduce/optimize the initially computed θ.

Figure 6:
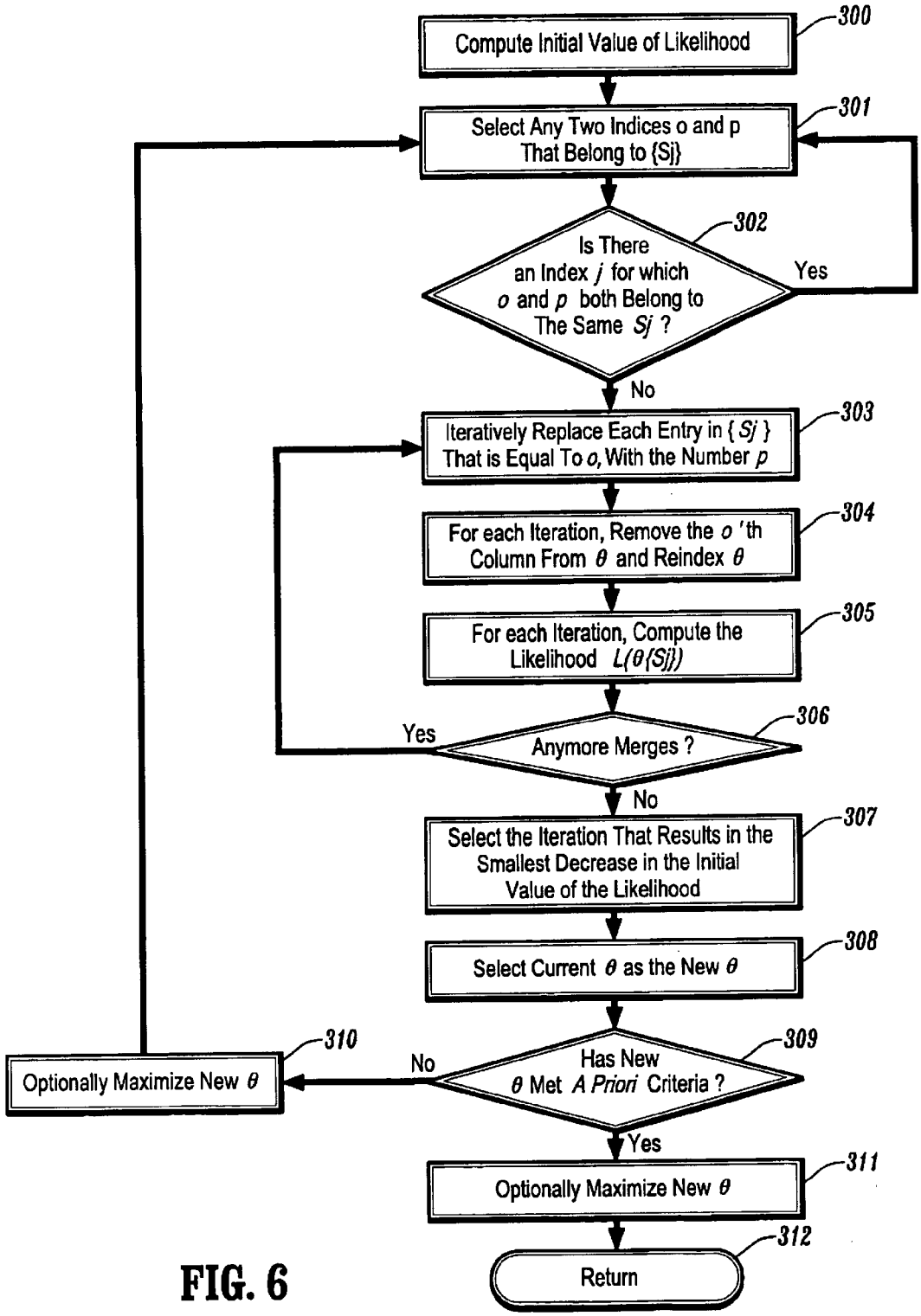
FIG. 6 comprises a flow diagram of a method for computing a optimizing a linear transformation according to one aspect of the present invention.

Referring to FIG. 6, this process begins by computing what is referred to herein as the "likelihood" L(θ,{$S_j$}) as follows (step 300):

$$L(\theta, \{S_j\}) = \sum_{j=1}^{J} N_j * \left(2\log|\theta_j| - \sum_{i=1}^{n} \log(\sigma_{j,i})\right), \quad \text{Equn. 9}$$

where $N_j$ refers to the number of data points in the training data that belong to the class j.

After the initial value of the likelihood in Equn. 9 is computed, the process proceeds with the selection (random or ordered) of any two indices o and p that belong to the set of subsets {Sj} (step 301). If there is an index j such that o and p belong to the same Sj (affirmative determination in step 301), another set of indices (or a single alternate index) will be selected (return to step 301). In other words, the numbers should be selected such that replacing the first number by the second number would not create an Sj that would have two numbers that are exactly the same. Otherwise, a deficient classifier would be generated. On the other hand, if there is not an index j such that o and p belong to the same Sj (affirmative determination in step 301), then the process may continue using the selected indices.

Next, each entry in {Sj} that is equal to o is iteratively replaced with p (step 303). For each iteration, the o'th column is removed from θ and θ is reindexed (step 304). More specifically, by replacing the number o with p, o does not occur in Sj, which means that that particular column of θ does not occur. Consequently, an adjustment to Sj is required so that the indices point to the proper location in θ. This is preferably preformed by subtracting 1 from all the entries in Sj that are greater than o.

After each iteration (or merge), the likelihood is computed using Equn. 9 above and stored temporarily. It is to be understood that for each iteration (steps 303–305) for a given o and p, θ is returned to its initial state. When all the iterations (merges) for a particular o and p are performed (affirmative decision in step 306), a new estimate of θ and {Sj} are generated by applying the "best merge." The best merge is defined herein as that choice of permissible o and p that results in the minimum reduction in the value of L(θ,{$S_j$}) (i.e., the iteration that results in the smallest decrease in the initial value of the Likelihood) (step 307). In other words, steps 303–305 are performed for all combination of possibilities in Sj and the combination that provides the smallest decrease in the initial value of the Likelihood (as computed using the initial values of Equn. 7 and 8 above) is selected.

After the best merge is performed, the resulting θ is deemed the new θ (step 308). A determination is then made as to whether the new θ has met predefined criteria (e.g., a minimum size limitation, or the overall net decrease in the Likelihood has met a threshold, etc.) (step 309). If the predefined criteria has not been met (negative determination in step 309), an optional step of optimizing θ may be performed (step 310). Numerical algorithms such as conjugate-gradients may be used to maximize $L(\theta,\{S_j\})$ with respect to θ.

This merging process (steps 301–308) is then repeated for other indices (nj) until the predefined criteria has been met (affirmative determination in step 309), at which time an optional step of optimizing θ may be performed (step 311), and the process flow returns to step 210, FIG. 5.

Returning back to FIG. 5, once all the parameters are computed, the parameters are stored for subsequent use during a classification process (step 210). The parameter estimation process is then complete (step 211).

It is to be appreciated that the techniques described above may be readily adapted for use with mixture models, and HMMs (hidden markov models). Speech Recognition systems typically employ HMMS in which each node, or state, is modeled as a mixture of Gaussians. The well-known expectation maximization (EM) algorithm is preferably used for parameter estimation in this case. The techniques described above readily easily generalize to this class of models as follows.

The class index j is assumed to span over all the mixture components of all the states. For example, if there are two states, one with two mixture components, and the other with three, then J is set to five. In any iteration of the EM algorithm, $\alpha_{i,j}$ is defined as the probability that the i'th data point belongs to the j'th component. Then the above Equations 7 and 8 are replaced with $$\mu_j = \frac{\sum_{i=1}^{N} \alpha_{i,j}\theta_j^T \chi_i}{\sum_{i=1}^{N} \alpha_{i,j}} \qquad \text{Equn. 10}$$

$$\sigma_j = \frac{\sum_{i=1}^{N} a_{i,j}(\theta_j^T \chi_i - \mu_j)^2}{\sum_{i=1}^{N} \alpha_{i,j}} \qquad \text{Equn. 11}$$

Similarly, the above Equations 3 and 4 are replaced with $$\overline{\chi}_j = \frac{\sum_{i=1}^{N} \alpha_{i,j}\chi_j}{\sum_{i=1}^{N} \alpha_{i,j}} \text{ and} \qquad \text{Equn. 12}$$

$$\Sigma_j = \frac{\sum_{i=1}^{N} \alpha_{i,j}(\chi_j - \overline{\chi}_j)(\chi_j - \overline{\chi}_j)^T}{\sum_{i=1}^{N} \alpha_{i,j}}. \qquad \text{Equn. 13}$$

The optimization is then performed as usual, at each step of the EM algorithm.

It is to be understood that FIGS. 5 and 6 illustrate one method to compute θ and corresponding $S_j$, and that there are other techniques according to the present invention to compute such values. For instance, the parameter estimation techniques described in the previous section, can be modified in various ways, for instance, by delaying some optimization, in the clustering process, or by optimizing for θ not on every step of the EM algorithm, but only after a few steps, or maybe only once.

Given k−1 columns of θ, the last column and the (possibly soft) assignments of training samples to the classes the remaining column of θ can be obtained as the unique solution to a strictly convex optimization problem. This suggest an iterative EM update for estimating θ. The so-called Q function in EM for this problem is given by:

$$\begin{aligned} Q &= const + \sum_{t,j} \gamma_j(t)\log p_j(\chi_t) \\ &= const - \frac{1}{2}\sum_{t,j} \gamma_j(t)\{-2\log|A_j| + \log|D_j| + \\ &\quad Tr\{A_j' D_j^{-1} A_j(\chi_t - \mu_j)(\chi_t - \mu_j)'\}\}, \end{aligned} \qquad \text{Equn. 14}$$

where $\gamma_j(t)$ is the state occupation probability at time t. Let P be a pool of directions and let $P_s$ be the subset associated with j. For any direction a, let S(a) be states that include direction a. Let $|A_j|=|c_{j,a}a'|$ where $c_{j,a}$ is the row vector of cofactors associated with complementary (other than a) rows of $A_j$. Let $d_j(a)$ be the variance of the direction a for state j (i.e., that component of $D_j$). For a $\epsilon P_j$ differentiating with respect to a (leaving all other parameters fixed):

$$0 = \sum_{j\in S(a),t} \gamma_j(t)\left\{-2\frac{c_{j,a}}{c_{j,a}a'} + 2\frac{a}{d_j(a)}(\chi_t - \mu_j)(\chi_t - \mu_j)'\right\}. \qquad \text{Equn. 15}$$

That is, $$\sum_{j\in S(a),t} \gamma_j(t)\frac{c_{j,a}}{c_{k,a}a'} = a\sum_{j\in S(a),t} \gamma_j(t)\frac{(\chi_t - \mu_j)(\chi_t - \mu_j)'}{d_j(a)}. \qquad \text{Equn. 16}$$

Let $$G = \sum_{j\in S(a),t} \gamma_j(t)\frac{(\chi_t - \mu_j)(\chi_t - \mu_j)'}{d_j(a)}.$$

Then we have the fixed point equation for a:

$$a = \sum_{j\in S(a)} \gamma_j \frac{c_{j,a}G^{-1}}{c_{j,a}a'},$$

where $$\gamma_j = \sum_t \gamma_j(t).$$

We suggest a "relaxation-scheme" for updating a:

$$a_{new} = \lambda a_{old} + (1-\lambda)\left(\sum_{j\in S(a_{old})} \gamma_j \frac{c_{j,a_{old}}G^{-1}}{c_{j,a_{old}}a'_{old}}\right),$$

for some $\lambda\epsilon[0,2]$. Once a direction is picked, $\gamma_j(t)$ can be computed again and find improve some other direction a in the pool P.

Another approach that may be implemented is one that allows assignment of directions to classes. The embodiment addresses how many directions to select and how to assign these directions to classes. Earlier, a "bottom-up" clustering scheme was described that starts with the PCA directions of $\Sigma_i$ and clusters them into groups based on an ML criterion. Here, an alternate scheme could be implemented that would be particularly useful when the pool of directions is small relative to the number of classes. Essentially, this is a top-down procedure, wherein we start with a pool of precisely n directions (recall n is the dimension of the feature space) and estimate the parameters (which is equivalent to estimating the MLLT (Maximum Likelihood Linear Transform) (see, R. A. Gopinath, "Maximum Likelihood modeling With Gaussian Distributions or Classification," *Proceedings of ICASSP*'98, Denver, 1998). Then, small set of directions are found which, when added to the pool, gives the maximal gain in likelihood. Then, the directions from the pool are reassigned to each class and re-estimate the parameters. This procedure is iterated to gradually increase the number of projections in the pool. A specific configuration could be the following. For each class find the single best direction that, when replaced, would give the maximal gain in likelihood. Then, by comparing the likelihood gains of these directions for every class, choose the best one and add it to the pool. This precisely increases the pool size by 1. Then, a likelihood criterion (K-means type) may be used to reassign directions to the classes and repeat the process.

Although illustrative embodiments have been described herein with reference to the accompanying drawings, it is to be understood that the present system and method is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. A method for classification, comprising the steps of:

capturing an input event;

extracting an n-dimensional feature vector from the input event;

applying a linear transformation to the feature vector to generate a pool of projections;

utilizing different subsets from the pool of projections to classify the feature vector; and outputting a class identity associated with the feature vector, wherein applying a linear transformation comprises transposing the linear transformation, and multiplying the transposed linear transformation by the feature vector, and wherein the transposed linear transformation comprises and n×k matrix, wherein k is greater than n, and wherein the pool of projections comprise a k×1 vector.

2. The method of claim 1, wherein a dimension of the pool of projections is greater than the dimension of the feature vector.

3. The method of claim 1, wherein the method is implemented in a maximum-likelihood framework.

4. The method of claim 1, wherein the method is implemented in a Gaussian framework.

5. The method of claim 1, wherein the linear transformation is used for all n-dimensional feature vectors in the input event.

6. The method of claim 1, wherein the step of utilizing different subsets from the pool of projections to classify the feature vector comprises the steps of:

for each predefined class, selecting a subset from the pool of projections associated with the class;

computing a score for the class based on the associated subset; and assigning, to the feature vector, the class having the highest computed score.

7. The method of claim 6, wherein each of the associated subsets comprise a unique predefined set of n indices computed during training, which are used to select the associated components from the computed pool of projections.

8. The method of claim 1, further comprising the step of computing an initial linear transform during a training stage, wherein the initial linear transform is one of minimized, optimized and both to create the linear transformation used for classification.

9. A program storage device readable by a machine, tangibly embodying a program of instructions executable by the machine to perform method steps for classification, the method steps comprising:

capturing an input event;

extracting an n-dimensional feature vector from the input event;

applying a linear transformation to the feature vector to generate a pool of projections;

utilizing different subsets from the pool of projections to classify the feature vector; and outputting a class identity associated with the feature vector, wherein the instructions for applying a linear transformation comprise instructions for transposing the linear transformation, and multiplying the transposed linear transformation by the feature vector, and wherein the transposed linear transformation comprises and n×k matrix, wherein k is greater than n, and wherein the pool of projections comprise a k×1 vector.

10. The program storage device of claim 9, wherein a dimension of the pool of projections is greater than the dimension of the feature vector.

11. A The program storage device of claim 9, wherein the method steps are implemented in a maximum-likelihood framework.

12. The program storage device of claim 9, wherein the method steps are implemented in a Gaussian framework.

13. The program storage device of claim 9, wherein the linear transformation is used for all n-dimensional feature vectors extracted from the input event.

14. The program storage device of claim 9, wherein the instructions for performing the step of utilizing different subsets from the pool of projections to classify the feature vector comprise instructions for performing the steps of:

for each predefined class, selecting a subset from the pool of projections associated with the class;

computing a score for the class based on the associated subset; and assigning, to the feature vector, the class having the highest computed score.

15. The program storage device of claim 14, wherein each of the associated subsets comprise a unique predefined set of n indices, computed during a training process, which are used to select the associated components from the computed pool of projections.

16. The program storage device of claim 9, further comprising instructions for performing the step of computing an initial linear transform during a training process, wherein the initial linear transform is one of minimized, optimized and both to create the linear transformation used for the classification.

* * * * *